United States Patent [19]

Tuhkanen et al.

[11] Patent Number: 4,822,640

[45] Date of Patent: Apr. 18, 1989

[54] COATER

[75] Inventors: Raimo Tuhkanen, Helsinki; Markku Grasten; Sivert Westergård, both of Järvenpää, all of Finland

[73] Assignee: Oy Wärtsilä Ab, Helsinki, Finland

[21] Appl. No.: 650,798

[22] Filed: Sep. 14, 1984

[30] Foreign Application Priority Data

Sep. 16, 1983 [FI] Finland ..... 833306

[51] Int. Cl.[4] ..... B05D 1/26; B05D 3/12; B05C 11/02; B05C 11/03

[52] U.S. Cl. ..... 427/211; 427/209; 427/356; 118/103; 118/122; 118/206; 118/411

[58] Field of Search ..... 118/206, 411, 103, 121, 118/122, 115, 117; 427/356, 358, 211, 209

[56] References Cited

U.S. PATENT DOCUMENTS

| | | | |
|---|---|---|---|
| 3,418,970 | 12/1968 | Phelps et al. | 118/413 X |
| 3,756,195 | 9/1973 | Mercier | 118/411 X |
| 3,981,122 | 9/1976 | Johnson | 118/411 X |
| 4,231,318 | 11/1980 | Zink | 118/411 X |
| 4,354,449 | 10/1982 | Zink | 118/206 X |
| 4,357,370 | 11/1982 | Alheed | 118/206 X |

*Primary Examiner*—Shrive Beck
*Assistant Examiner*—Alain Bashore
*Attorney, Agent, or Firm*—Dellett, Smith-Hill and Bedell

[57] ABSTRACT

An appliance for a double-sided coating of a moving web by means of two coating substance applicators and a smoothing nip comprising a back-up roll on one side of the web and a adjustable levelling blade or the like on the other side of the web. The coating substance is supplied on the web directly on the side facing the levelling blade and on the surface of the back-up roll or the web on the other side of the web. The smoothing nip and the both applicators are located within a 30 degrees sector of the back-up roll, preferably within a 20 degrees sector.

20 Claims, 2 Drawing Sheets

COATER

BACKGROUND OF THE INVENTION

The present invention relates to improvements in coating applicances such as for applying coating substances to both sides of a moving web, for instance a paper or a cardboard web.

In a coater, where a moving web is simultaneously coated on both sides, the supply of coating substance on the web generally takes place at the same position on both sides of the web. After this the web moves through a smoothing nip, where the excess of coating substance is removed and the coating layer is levelled. In known coaters of this kind there happens quite easily ruptures of the web especially when the web to be coated is thin and when the web is coated on one side with thick coating substance and on the other side with thin coating substance. The rupture of the web is due to two different reasons. Firstly, if the coating substance of one side is substantially thinner than the coating substance of the other side, the web is not always moving rectilinear, but there is generated waves in different points due to the different viscosity of the coating substances. This bearing causes easily ruptures of the web especially at high speeds of the web. Secondly, when supplying coating substance on the web at the same time on both sides, the liquid component of the coating substance is simultaneously absorbed in the web on its both sides, and the tensible strength of a wet web is substantially smaller than that of a dry web.

There is also known an apparatus for simultaneously doublesided coating of a web, such as disclosed in U.S. Pat. No. 4,357,370, where the coater comprises a back-up roll transmitting coating to one side of the web and a trailing blade coater applying coating on the opposite side of the web. This apparatus makes it possible to apply coatings of different kinds on each side of the web. The arrangement, however, incorporates some drawbacks when attempting to get a smooth coating of high quality on both sides of the web. Firstly, the applicators are of the short dwell type, i.e. the coater lacks a separate smoothing nip after the applying of coating on the web. Secondly, the applying of coating on the web side facing the back-up roll is carried out in a manner, that gives a satisfactory coating layer only for coatings with low quality demands, such as sizing. The centrifugal force having effect upon the coating substance fastened to the back-up roll will cause splashing of coating to the web, and the long contact surface between the web and the back-up roll has a disadvantageous effect upon the levelling of the surface layer.

The object of the inventon is to provide an improved coater for achieving a smooth and uniform coating surface of high quality on both sides of a moving web. A further object of the invention is to improve the state of function of a coater, i.e. to provide an improved coating mechanism that minimizes the risk of web rupture even at high web speeds. A still further object is to provide improvements of a coater such as the one described in the U.S. patent application Ser. No. 580,882.

The characteristic features of the invention are disclosed in claim 1. A coating appliance according to this construction achieves the object of the invention. This issues firstly from the matter, that on one side of the web the coating substance at first is spread on the surface of the back-up roll and then is transmitted from this to the web at the very smoothing nip itself, and secondly from the matter, that the both applicators are located very close to the smoothing nip. The attempt is to locate the spreading positions of the coating substance and the smoothing nip within a 30° sector of the back-up roll, preferably within a 2020 sector.

In a preferred embodiment of the inventon both applicators are of the extrusion type, which through a supply slit by means of a very light excess pressure supply coating substance on the moving surfaces. It is important, that the applicator supplying coating substance on the roll is adjusted so, that the amount of coating substance supplied does not exceed the required amount of coating substance to such an extent, that an excessive pool is formed below the smoothing nip by virtue of the web moving upwards at high speed.

When the coating substance is almost pressureless in the nozzles of the applicators, the air following the coating substance will not expand since the pressure remains constant and thus uncoated areas on the web will not be caused. This phenomenon occurs in known coaters, where the moving direction of the web is opposite and the smoothing nip is formed by the bottom slit of a coating substance damming. In known coaters of this type a further drawback is the hydrostatic pressure of the damming, which rises to a remarkable degree, because the height of the damming surface has to be big enough to allow the excess of coating substance to flow away from the ends of the basin. Due to these leakages it is not possible to leave the edge zones of the web uncoated nor to arrange the control devices of the blades, nozzles etc. at the gables, which is both possible and preferable in a coater according to the invention.

Leaving the edge zones uncoated is a necessity, when for example one side is coated with surface sizing and the other side with pigment coating, when it is wanted to have different basis weights for the coatings of the different sides of the web, a task that succeeds in the best manner by changing the content of dry substance of the coating substance, or when it is wanted to leave one side wholly uncoated.

The applicator located at the web side facing the levelling blade or the like operates together with a support located at the opposite side of the web. In a favourable embodiment of the invention this support may be an adjustable rigid support such as a level blade, the surface of which is made of a plastic material having a low friction coefficient. The support may instead of a level blade comprise a support roll. The space that the support demands in the direction from the web to the back-up roll is small, and due to this the applicator in question can be placed very close to the smoothing nip.

The moving direction of the web is from below upwards, but it does not have to be exactly upright, instead it may differ somewhat from the vertical plane prior to the smoothing nip, preferably in a direction pointing away from the back-up roll. After the smoothing nip the moving direction of the web preferably differs clearly from the direction of a tangent line of the back-up roll drawn through the smoothing nip, in a direction pointing away from the back-up roll. This being the case there is generated a refracting point at the levelling blade or the like, which reduces the contact surface between the web and the back-up roll and thus improves the quality of the coating. By this arrangement also the coating on the web side facing the back-up roll will be levelled at the smoothing nip.

A further advantage in a coater according to the invention is the possibility to use the coater in the same way as the coater described in the mentioned U.S. patent application, by arranging the applicator on the roll side of the web mountable into a turned position.

DESCRIPTION OF THE DRAWING

The invention will in the following be explained more accurately with reference to the accompanying drawing, the FIG. 1 of which schematically illustrates an end elevational view of the preferred embodiment of a coater according to the invention.

DESCRIPTION OF THE PREFERRED EMBODIMENT

Figure 1:
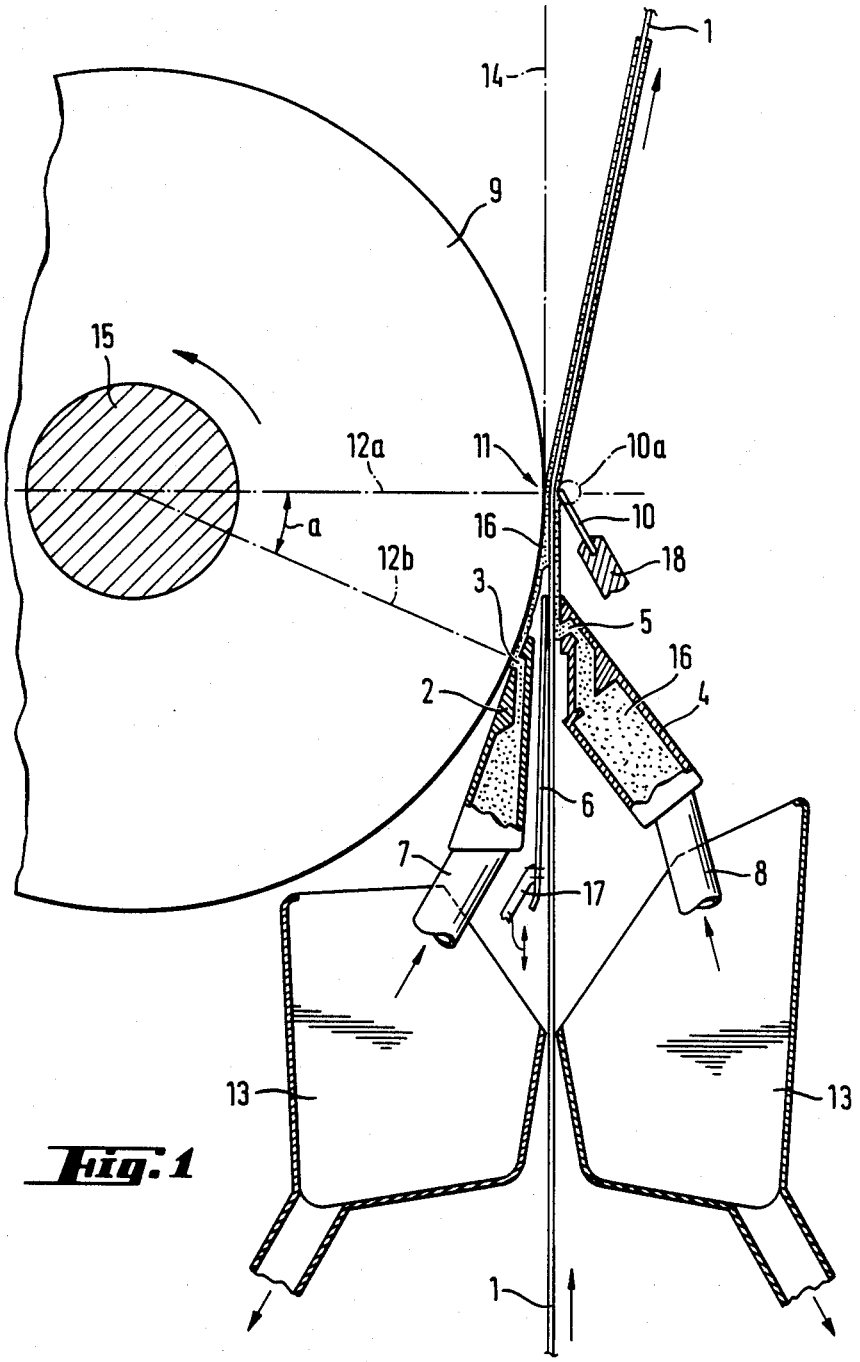

In the drawing, numeral 1 indicates a moving web, 10 a levelling blade and 9 a back-up roll having a back-up roll-shaft 15. The levelling blade 10 can be replaced by a levelling bar 10*a*. The smoothing nip 11 is the section between the back-up roll 9 and the levelling blade 10 or the like mounted on an adjustable blade support 18. On the roll side of the web there is a first wedge-shaped coating substance applicator 2, which spreads coating substance 16 on the surface of the back-up roll 9, from which it is supplied to the web 1 at the smoothing nip 11. On the opposite side of the web 1 there is a corresponding second applicator 4, which spreads coating substance 16 directly on the web. The coating substance 16, paste or glue, is pumped through the connections 7 and 8 to the applicators 2 and 4, from which it is extruded from the nozzles of both applicators 2 and 4 through the slits 3 and 5 to the surface of the web 1 or the roll 9. The applicators 2 and 4 are independently mountable and adjustable and they are at a distance of a few millimeters from the surface to be coated without touching the moving surface, which reduces the risk of web rupture. The distance from the slit of the nozzle to the web 1 or the roll 9 is then suitable, when only a small amount of coating substance 16 is falling to the collection tanks 13 below the applicators 2 and 4.

The coating substance 16 spread from the slit 3 on the roll 9 moves with the rotating roll 9 towards the smoothing nip 11, in front of which comes in contact with web 1 and in which the amount of coating substance 16 is regulated by the pressure of the levelling blade 10 or levelling bar 10a. The amount of coating substance 16 remaining on both sides of the web 1 is determined by the same regulation of blade pressure. The coating substance 16 coming from the slit 5 of the nozzle of applicator 4 presses the web 1 against the rigid support plate 6 on the opposite side of the web, which plate prevents the web from bending and the surface of which preferably is coated with plastic in order to get a very smooth surface. The support plate 6 prevents also the excess of coating substance 16 between the roll 9 and the web 1, taken off at the smoothing nip 11, from falling down on the web 1, leading it instead to the collection tank 13. Numeral 17 indicates schematically a vertically movable support for the support plate 6.

In a coater, where the smoothing nip 11 and the center point of the back-up roll 9 are in the same horizontal plane, the tangent line 14 of the back-up roll drawn through the smoothing nip 11 is vertical. The direction of the web 1 below the smoothing nip diverges at most 5° from the direction of the tangent line, preferably away from roll 9. After the smoothing nip 11 the web 1 turns off in a direction away from the roll 9 preferably 3°. . . 5°, at most 7°. This change of the direction of the web 1 influences advantageously the distribution of the surface layer into the surface of the roll 9 and into the part remaining on the surface of web 1, so that the surface of the part remaining on the web 1 becomes smoother than if the web 1 should move in the direction of the tangent line 14 of the back-up roll 9.

Due to their wedge-shaped construction the nozzles of the applicators 2 and 4 can be brought very close to the smoothing nip 11. The distance from the smoothing nip 11 to the slits 3 and 5 of the said nozzles can be 100 mm or less. In practice the distance is dependent on the diameter of the back-up roll 9. In a coater according to the invention the attempt is, that the angle a of the sector of the back-up roll, the lines of demarcation 12*a* and 12*b* of which sector go through the smoothing nip 11 and the spreading point 3 most far from it, is at most 30°, preferably at most 20°.

Figure 2:
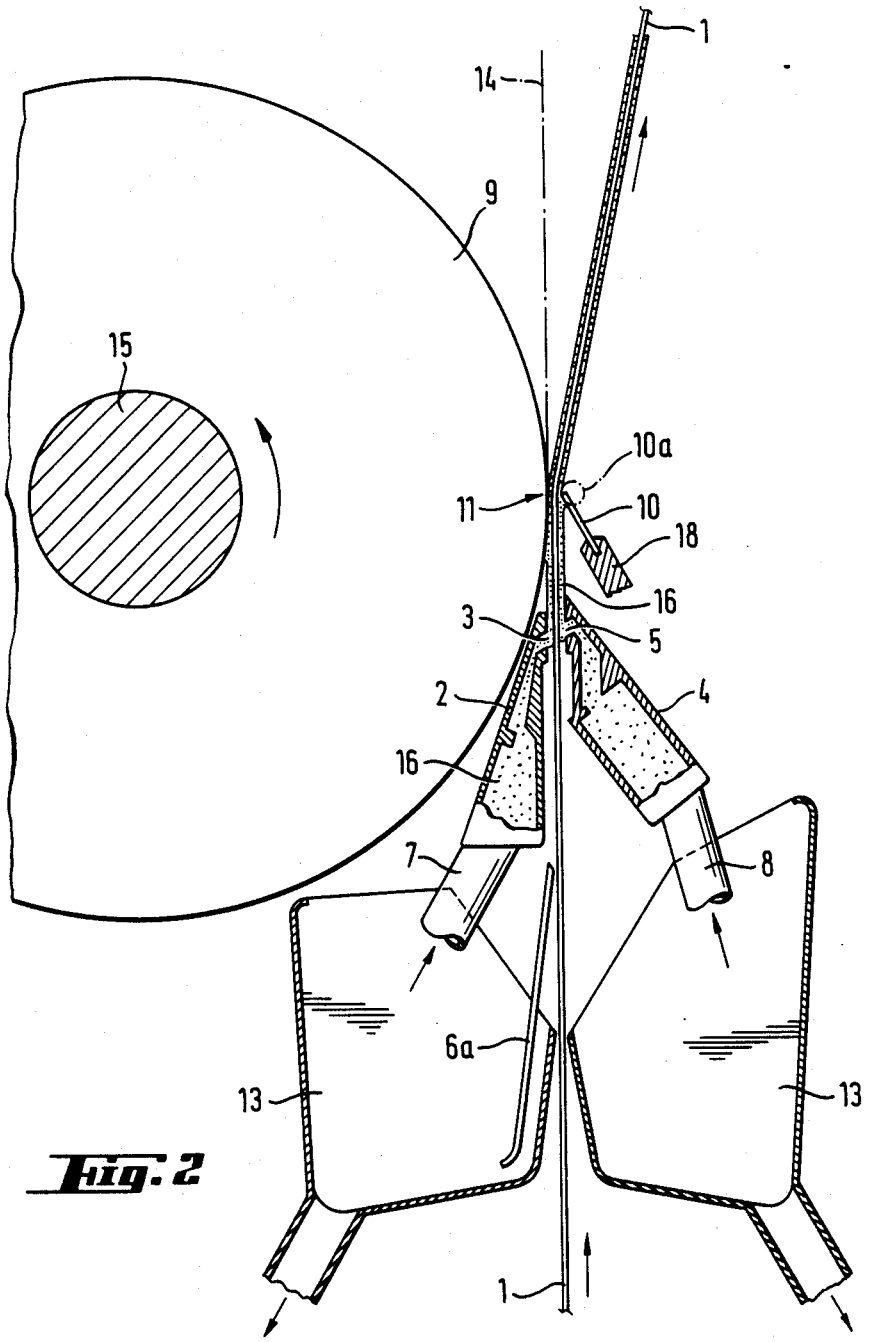
FIG. 2 illustrates an alternative way of using the coater of FIG. 1.

In FIG. 2 is shown an alternative way of using a coater according to the invention. The nozzle 2 is mounted in a turned position, so that the slits 3 and 5 of the nozzles 2 and 4 are opposite each other on different sides of the web. Hereby the support plate 6 has to be lowered to the position 6*a*. The state of function of the coater is very good also in this mode.

The invention is not limited to the embodiment shown, but several modifications thereof are feasible within the scope of the attached claims.

We claim:

1. An appliance for a double-sided coating of a moving web, for instance a paper or a cardboard web, comprising in combination:

means for advancing the web in a direction from below upwards;

a first and a second applying station for applying a coating substance to respective moving surfaces; a smoothing nip for the final evening-out of the coating, which nip is located separately after the applying stations in the moving direction of the web, said nip comprising an adjustable levelling blade or bar on one side of the web and a rotatable back-up roll on the other side of the web;

said first applying station including a first applicator, located between the web and said back-up roll, said first applicator being mountable and adjustable into first and second positions for applying coating substance selectively to the moving surface of either said back-up roll or the web;

said second applying station including a second applicator, located on the web side facing said levelling blade, for applying coating substance directly on the web.

2. An appliance according to claim 1, in which said first applicator applies coating substance to the surface of said back-up roll, which roll brings the coating substance to said smoothing nip, at which the back-up roll receives the web and hereby coats the surface of the moving web.

3. An appliance according to claim 1, in which the said first applicator is arranged mountable into a turned position between the web and the said back-up roll, so that coating substance can be supplied by the said first applicator directly on the web.

4. An appliance according to claim 1, in which the both said applicators are located so close to the smoothing nip, that the applying positions of the coating substance and the smoothing nip are located within a 30 degrees sector of said back-up roll, preferably within a 20 degrees sector of the back-up roll.

5. An appliance according to claim 1, in which the both applicators are of the extrusion type, which by means of a very light excess pressure supply coating substance to the web.

6. An appliance according to claim 1, in which the moving direction of the web differs prior to the smoothing nip at most 5° from the direction of the tangent line of the said back-up roll passing through the said smoothing nip, preferably deflected away from said back-up roll, and in which the moving direction of the web after the smoothing nip differs at least 3° and at most 10° from the direction of said tangent line in a direction pointing away from the back-up roll.

7. An appliance according to claim 1, in which the distance between the applicator and the said moving surface is arranged to allow just a small amount of coating substance spread on said surface to drop down beneath the applicators.

8. An appliance according to claim 1, wherein the dimension of the first applicator in a direction perpendicular to the web reduces in the direction of movement of the web.

9. An applicator according to claim 8, wherein the first applicator is wedge shaped.

10. An appliance for double-sided coating of a running web, comprising a rotatable back-up roll, a levelling member which cooperates with the roll to define a smoothing nip, first and second coating substance applicators positioned below the smoothing nip and spaced apart therefrom along a path of movement of the web, the first applicator being located between the back-up roll and the path of movement of the web and being adjustable between a first condition in which it is disposed for applying coating substance to the moving surface of the back-up roll and a second condition in which it is disposed for applying coating substance to the web, and the second applicator being disposed for applying coating substance directly to the side of the web facing the levelling member.

11. An appliance according to claim 10, wherein the first applicator is in its first condition and the appliance further comprises a support member located between the back-up roll and the path of movement of the web to resist movement of the web away from the second applicator.

12. An appliance according to claim 10, wherein the first applicator is in its first condition and the appliance further comprises a support member located between the back-up roll and the path of movement of the web to resist movement of the web away from the second applicator, the support member being removable to a lower position, and wherein the first applicator is located substantially directly opposite the second applicator across the path of movement of the web when the first applicator is in its second condition.

13. An appliance according to claim 10, wherein the first applicator is located closely spaced from the path of movement of the web and from the back-up roll, and the second applicator is located closely spaced from said path of movement.

14. An appliance according to claim 10, wherein when the first applicator is in its first condition the smoothing nip and the position at which coating substance is applied to the back-up roll are within a 30 degree sector of the back-up roll.

15. An appliance according to claim 14, wherein the smoothing nip and the position at which coating substance is applied to the web are within a 20 degree sector of the back-up roll.

16. An appliance for coating at least one side of a running web, comprising a rotatable back-up roll, a levelling member which cooperates with the roll to define a smoothing nip, and a coating substance applicator positioned below the smoothing nip and spaced apart therefrom along a path of movement of the web and adjustable between a first condition in which it is disposed for applying coating substance to the moving surface of the back-up roll and a second condition in which it is disposed for applying coating substance to the web.

17. An appliance according to claim 16 further comprising a second coating substance applicator positioned below the smoothing nip and spaced apart therefrom along said path of movement, the second coating substance applicator being disposed in confronting relationship across said path of movement with the first-mentioned applicator when in its second condition, for applying coating substance to that side of the web which is towards the levelling member.

18. A method of coating running lengths of web material, for instance webs of paper or cardboard, using an appliance comprising a rotatable back-up roll, a levelling member which cooperates with the roll to define a smoothing nip, and a coating substance applicator positioned below the smoothing nip and spaced apart therefrom along a predetermined path of movement, the applicator being located between the back-up roll and said path of movement and being adjustable between a first condition in which it is disposed for applying coating substance to the moving surface of the back-up roll and a second condition in which it is disposed for applying coating substance to a length of web material being advanced along said path of movement, said method comprising advancing a first length of web material upwardly along said path of movement while said coating substance applicator is in said first condition, delivering coating substance to the coating substance applicator, whereby coating substance is applied to the moving surface of the back-up roll and is transferred to the first length of web material, adjusting the coating substance applicator to its second condition, advancing a second length of web material upwardly along said path of movement, and delivering coating substance to the coating substance applicator, whereby coating substance is applied directly to the web.

19. A method according to claim 18, wherein a second coating substance applicator is positioned below the smoothing nip and spaced apart therefrom along said path of movement, said second coating substance applicator being disposed in confronting relationship across the web with respect to the first-mentioned applicator when in its second condition, for applying coating substance to that side of the web which is towards the levelling member, and the method also comprises delivering coating substance to the second coating substance applicator while the first and second lengths of web material are advanced along said path of movement, whereby coating substance is applied to both sides of the lengths of web material.

20. A method according to claim 19, using an appliance comprising a support member that can be located between the back-up roll and said path of movement when the first-mentioned applicator is in its first condition, and the method comprising positioning the support member between the back-up roll and said path of movement for supporting the first length of web material against the second applicator, and removing the support member when the first-mentioned applicator is adjusted to its second condition so that the second length of web material is supported by the first-mentioned applicator against the second applicator.

* * * * *